United States Patent [19]

Jensen

[11] Patent Number: 5,046,521

[45] Date of Patent: Sep. 10, 1991

[54] MOUNTING ASSEMBLY FOR IN-THE-WALL PLUMBING FITTING

[75] Inventor: Hans-Jürgen Jensen, Welver, Fed. Rep. of Germany

[73] Assignee: Friedrich Grohe Armaturenfabrik GmbH & Co., Hemer, Fed. Rep. of Germany

[21] Appl. No.: 487,428

[22] Filed: Mar. 1, 1990

[30] Foreign Application Priority Data

Mar. 9, 1989 [DE] Fed. Rep. of Germany ..... 3907588

[51] Int. Cl.[5] ..... F16L 5/00

[52] U.S. Cl. ..... 137/360; 137/359

[58] Field of Search ..... 4/192; 137/359, 360

[56] References Cited

U.S. PATENT DOCUMENTS

| | | | |
|---|---|---|---|
| 2,747,604 | 5/1956 | Fraser | 137/360 |
| 2,903,712 | 4/1959 | Morris et al. | 4/170 |
| 3,807,453 | 4/1974 | Dom et al. | 137/359 |
| 4,552,171 | 11/1985 | Farrell et al. | 137/359 |
| 4,804,010 | 2/1989 | Meissenberg | 137/359 |
| 4,848,395 | 7/1989 | Krippendorf | 137/359 |

FOREIGN PATENT DOCUMENTS

| | | |
|---|---|---|
| 1209516 | 1/1966 | Fed. Rep. of Germany . |
| 3519652 | 12/1986 | Fed. Rep. of Germany . |

*Primary Examiner*—A. Michael Chambers

*Attorney, Agent, or Firm*—Herbert Dubno; Andrew Wilford

[57] ABSTRACT

An assembly for mounting a fitting, for instance a mixing faucet, to a wall has an anchor plate fixable in the wall, a threaded stud fixed to and projecting longitudinally forward from the anchor plate, and a formation on the fitting formed with a throughgoing aperture through which the stud projects. A back nut threaded on the stud has a front face bearing forward on the formation at the aperture and a front or counternut threaded on the stud has a back face bearing backward on the formation of the aperture. Thus the formation is longitudinally captured between the nuts and same can be screwed along the stud to longitudinally displace and position the fitting therealong.

9 Claims, 2 Drawing Sheets

MOUNTING ASSEMBLY FOR IN-THE-WALL PLUMBING FITTING

FIELD OF THE INVENTION

The present invention relates to a mounting assembly. More particularly this invention concerns such an assembly for mounting an in-the-wall plumbing fitting, such as a wall-mount mixing valve, during construction.

BACKGROUND OF THE INVENTION

A standard plumbing fitting such as described in German patent document 3,519,652 filed 01 June 1985 by Luke Rainer has a mounting plate that is fixed in the Wall and to Which hot- and cold-water risers are connected. To this end an anchor plate is bolted in the wall and carries a threaded stud that projects perpendicular to the wall surface from this anchor. For mounting the fitting, same is simply screwed down onto the threaded stud and, once it is in the desired position, a counternut is screwed forward along the stud against the back of the fitting to lock it in place. Then the water connections are made to the fitting.

Such an arrangement has several disadvantages. First of all it is necessary to get at least limited access to the back of the fitting to tighten the counternut. It is also necessary to be able to rotate the entire fitting to install it, so installation in cramped surroundings is difficult or impossible. Finally, there is no way to adjust the position of the fitting subsequent to installation, as once the fitting is connected to the hot- and cold-water lines it is impossible to rotate the fitting and screw it along the stud. Finally the metal-to-metal mounting of the fitting to the stud makes for good sound transmission from the fitting to the anchor and through this anchor to the wall.

OBJECTS OF THE INVENTION

It is therefore an object of the present invention to provide an improved mounting assembly for a plumbing fitting or the like.

Another object is the provision of such an improved mounting assembly for a plumbing fitting or the like which overcomes the above-given disadvantages, that is which allows the fitting to be mounted in a tight location, which allows the position of the fitting to be adjusted even after the wall is complete, and which finally provides good sound insulation of the fitting from the surrounding structure.

SUMMARY OF THE INVENTION

An assembly for mounting a fitting to a wall according to this invention has an anchor fixable in the wall, a threaded stud fixed to and projecting longitudinally forward from the anchor, and a formation on the fitting formed with a throughgoing aperture through which the stud projects. A back nut threaded on the stud has a front face bearing forward on the formation at the aperture and a front or counternut threaded on the stud has a back face bearing backward on the formation of the aperture. Thus the formation is longitudinally captured between the nuts and same can be screwed along the stud to longitudinally displace and position the fitting therealong.

With this arrangement, therefore, the fitting need not be rotated to fit it to the stud, and even after the fitting is installed, its position along the stud can be adjusted. This latter feature is made particularly easy whe.. the back nut is formed with a collar projecting forward through the aperture and having a front end formed with tool-engaging facets. Thus a tool fitted to the facets can screw the back nut forward or backward to adjust the fitting position. In such an arrangement the front nut can be formed with a backwardly projecting collar surrounding the back-nut collar and formed with the back face.

For most effective sound insulation the assembly of this invention comprises a U-section elastomeric ring surrounding the stem in the aperture between the nuts and having front and back flanges respectively lying between the back and front faces and the formation. To prevent damage to this soft ring, front and back hard washers are provided between the front and back flanges and the respective back and front faces. Alternately the front nut includes a front part and a back part rotatable relative to each other about an axis of the stud but axially relatively nondisplaceable with the back part forming the back face.

In accordance with further features of this invention the anchor is provided with three such studs extending parallel to and offset laterally from one another. Furthermore the fitting has respective formations with respective apertures engaged over the studs and the studs are provided with respective front and back nuts. The fitting can be a mixing faucet having a connection stem and a cover plate centered on the stem in which case the studs are equispaced from the stem and normally are covered by the plate.

DESCRIPTION OF THE DRAWING

The above and other objects, features, and advantages will become more readily apparent from the following, reference being made to the accompanying drawing in which.

SPECIFIC DESCRIPTION

Figure 1:
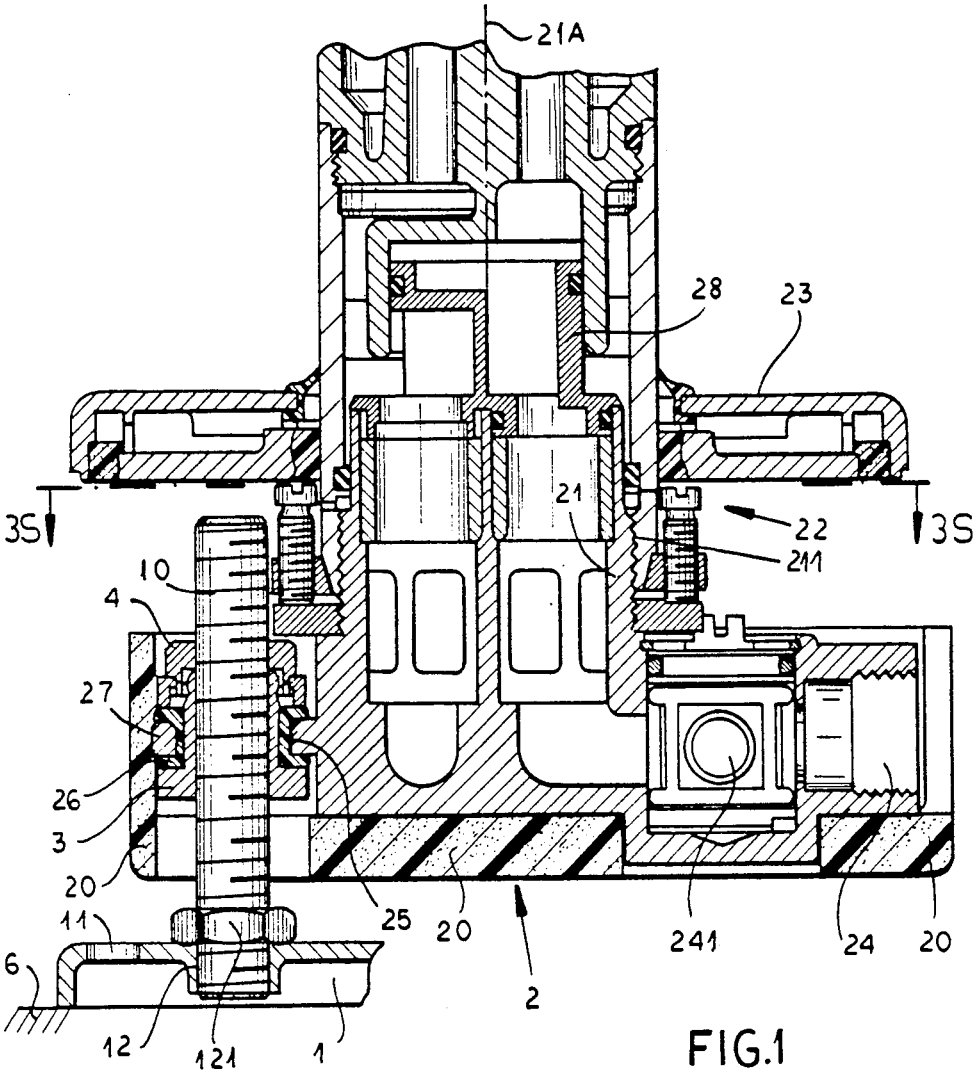
FIG. 1 is an axial section taken along line 1S—1S of FIG. 3.
Figure 2B:
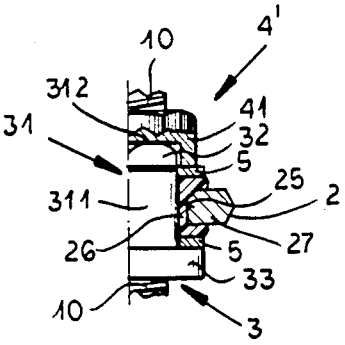
FIG. 2B is a view like FIG. 2A but showing a variant on the invention.
Figure 2A:
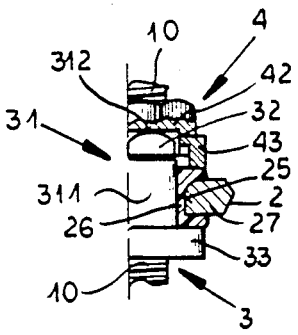
FIG. 2A is a view of a detail of FIG. 1.
Figure 3:
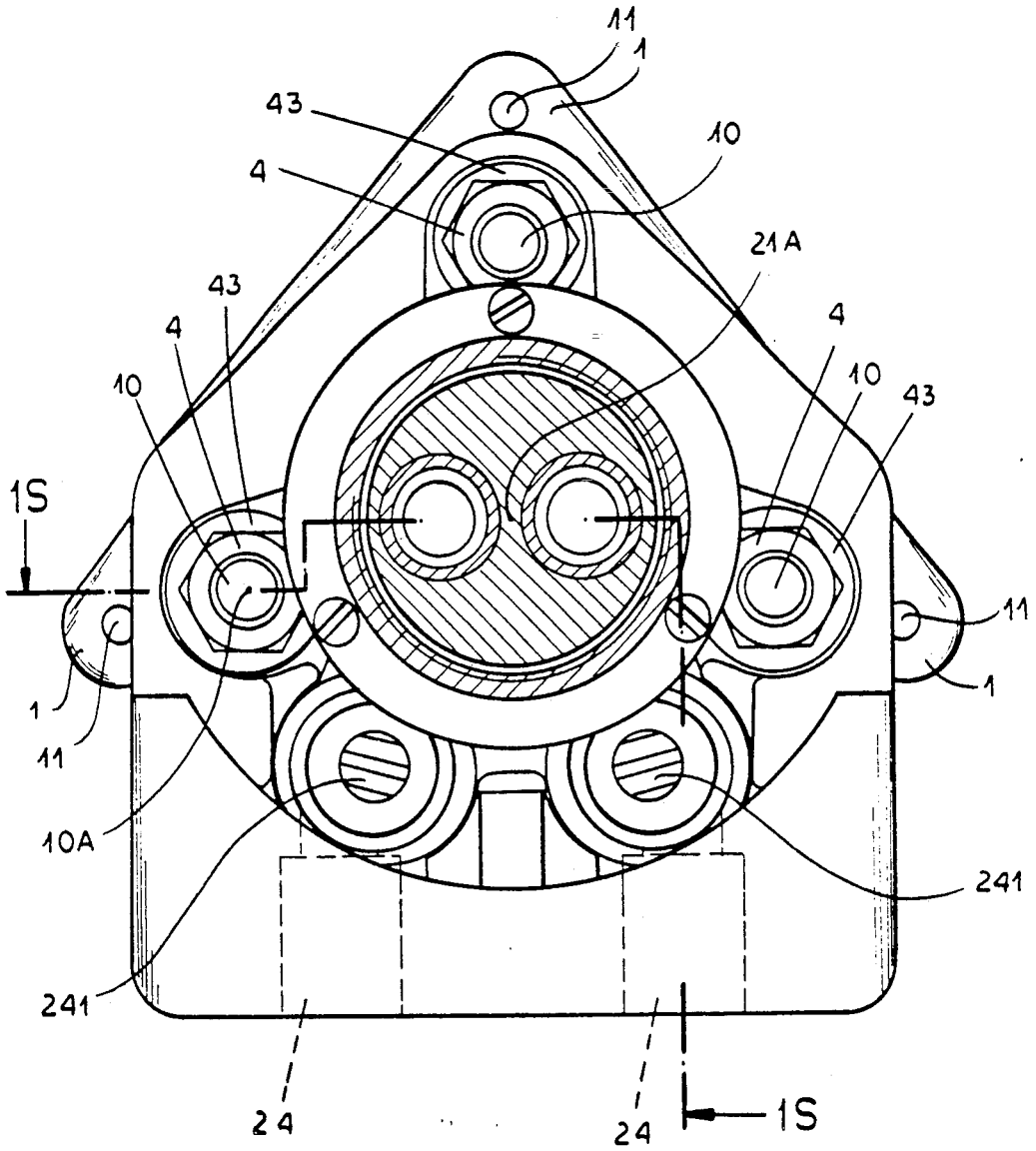
FIG. 3 is a section taken along line 3S—3S of FIG. 1.

As seen in FIGS. 1, 2A, and 3 an anchor plate 1 is formed with holes 11 by means of which it can be lag-bolted or otherwise fastened solidly to a wall shown schematically at 6. This plate 1 is formed with three threaded holes 12 centered on respective axes 10A and each receiving a respective threaded rod or stud 10 With the axes 10A all parallel and normally perpendicular to the normally vertical wall 6. Respective lock nuts 121 are threaded on the studs 11 down against the plate 1 to lock the studs 10 in place thereon.

A valve fitting 2 comprises a metallic body 21 formed mainly as a threaded stem centered on an axis 21A from which the axes 10A are radially equispaced and about which the axes **10*a* are angularly spaced. The fitting 2 is provided with hot-and cold-water inlet ports 24 and with respective barrel-type cutoff valves 241 that can be operated by a screwdriver. A mass 20 of synthetic-resin foam insulation surrounds at least the back and side surfaces of the fitting 2. A faucet 22 can be screwed back onto the stem 21 with an adapter 28 fitted between the two parts 22 and 21, and an annularly circular cover plate 23 can be slid back on the faucet 22**, all as described in commonly owned co-pending patent application 485,380 filed 26 February 1990 to which reference should be made for further details.

According to this invention the fitting 2 is formed with three tab formations 27 each in turn formed with an axially throughgoing aperture 25 through which a respective one of the studs 10 projects with some play. As seen in better detail in FIG. 2A each stud 10 is fitted with a back nut 3 bearing axially forward on the respective tab 27 and with a front or counternut 4 that bears axially backward thereon.

More specifically, the back nut 3 is generally T-shaped, having a rear flange 33 and a forwardly directed collar 31 itself having a rear part 311 of cylindrical shape that fits in the respective aperture 25 around the stem 10 and a front part 312 projecting forward past the tab 27 and formed with facets 32 so it can be engaged by a wrench. The front nut 4 is generally U-shaped and comprises a front part 42 and rear part 43 that can rotate about the axis 10A relative to each other but that cannot be axially separated. A U-section elastomeric washer 26 fits in the aperture 25 and has a front flange lying on the front face of the respective tab 27 and a back flange lying on its back flange.

Alternately as seen in FIG. 2B a front washer 4' can be unitarily formed with a skirt 41 that fits backward around the projecting front end 312 of the collar 31. Flat metallic washer 5 lie between the front flange of the washer 26 and the skirt 41 and between the back flange and the flange 33 to prevent these parts from damaging the soft washer 26 as they rotate.

With this system, therefore, the plate 1 is first fixed in the wall at the location where the faucet 22 is to be mounted. Then the studs 10 are fixed with their lock nuts 121 to the plate 1 and the back nuts 3 are threaded down over these studs 10. The mounting plate 2 is then fitted down over the three studs 10 with each stud 10 passing through a respective washer 26 and the front nuts 4 (or 4') are loosely screwed in place.

Thereafter the connections are made to the inlet ports 24 and the valves 241 can be closed to test these connections. Normally at this time a template/shield (see the above-cited copending patent application) is secured to the plate 2.

The wall can then be completed, leaving a hole around the stem 21 large enough to leave the nuts 4 and the valves 241 exposed once the template/shield is removed. Once the wall is finished, for instance by tiling, the position of the plate 2 can be adjusted along the axes 10A by removing the nuts 4 and actuating the nuts 3 via their tool facets 32. Once the desired position is obtained the nuts 4 are screwed down tight to lock the plate 2 in position.

The faucet 22 is then screwed onto the stem 21 and the valves 241 opened. Then the escutcheon 23 is slipped on to complete the installation.

I claim:

1. An assembly for mounting a fitting to a wall, the assembly comprising:

an anchor fixable in the wall;

a threaded stud fixed to and projecting longitudinally forward from the anchor;

a formation on the fitting formed with a throughgoing aperture through which the stud projects;

a back nut threaded on the stud, spaced longitudinally forward of the anchor, and having a front face bearing forward on the formation at the aperture; and a front nut threaded on the stud and having a back face bearing backward on the formation of the aperture, whereby the formation is longitudinally captured between the nuts and same can be screwed along the stud to longitudinally displace and position the fitting therealong.

2. An assembly for mounting a fitting to a wall, the assembly comprising:

an anchor fixable in the wall;

a threaded stud fixed to and projecting longitudinally forward from the anchor;

a formation on the fitting formed with a throughgoing aperture through which the stud projects;

a back nut threaded on the stud, having a front face bearing forward on the formation at the aperture, and formed with a collar projecting forwardly through the aperture and having a front end formed with tool-engaging facets; and a front nut threaded on the stud and having a back face bearing backward on the formation of the aperture, whereby the formation is longitudinally captured between the nuts and same can be screwed along the stud to longitudinally displace and position the fitting therealong.

3. The mounting assembly defined in claim 2 wherein the front nut is formed with a backwardly projecting collar surrounding the back-nut collar and formed with the back face.

4. The mounting assembly defined in claim 1, further comprising a U-section elastomeric ring surrounding the stem in the aperture between the nuts and having front and back flanges respectively lying between the back and front faces and the formation.

5. The mounting assembly defined in claim 4, further comprising front and back hard washers between the front and back flanges and the respective back and front faces.

6. The mounting assembly defined in claim 4 wherein the front nut includes a front part and a back part rotatable relative to each other about an axis of the stud but axially relatively nondisplaceable, the back part forming the back face.

7. The mounting assembly defined in claim 1 wherein the anchor is provided with three such studs extending parallel to and offset laterally from one another, the fitting having respective formations with respective apertures engaged over the studs, the studs being provided with respective front and back nuts.

8. The mounting assembly defined in claim 7 wherein the fitting is a mixing faucet having a connection stem and a cover plate centered on the stem, the studs being equispaced from the stem and normally covered by the plate.

9. In combination with a mixing valve having a mounting plate adapted to be fixed in a wall, an assembly comprising:

an anchor fixable in the wall;

a plurality of transversely spaced but generally parallel threaded studs fixed to and projecting longitudinally forward from the anchor;

respective formations on the fitting each formed with a throughgoing aperture through which a respective one of the studs projects;

respective back nuts threaded on the studs, spaced longitudinally forward of the anchor, and each having a front face bearing forward on the respective formation at the respective aperture; and respective front nuts threaded on the stud and each having a back face bearing backward on the respective formation of the respective aperture, whereby the formations are longitudinally captured between the respective nuts and same can be screwed along the respective studs to longitudinally displace and position the fitting therealong.

* * * * *